US005182593A

United States Patent [19]

Fischer

[11] Patent Number: 5,182,593

[45] Date of Patent: Jan. 26, 1993

[54] ROLLER TANK

[75] Inventor: Warren Fischer, St. Charles, Ill.

[73] Assignee: Fischer Industries, Inc., Geneva, Ill.

[21] Appl. No.: 641,459

[22] Filed: Jan. 14, 1991

[51] Int. Cl.[5] ..... G03D 3/08

[52] U.S. Cl. ..... 354/322

[58] Field of Search ..... 354/319, 320, 324, 323, 354/331, 322, 313-316, 318

[56] References Cited

U.S. PATENT DOCUMENTS 4,324,479 4/1982 Sachs ..... 354/324 X 4,515,456 5/1985 Ferrante ..... 354/320

4,941,008 7/1990 Nakamura ..... 354/320

*Primary Examiner*—Michael L. Gellner

*Assistant Examiner*—D. Rutledge

*Attorney, Agent, or Firm*—Polster, Lieder, Woodruff & Lucchesi

[57] ABSTRACT

The front, back and bottom walls of the tanks containing the solutions are constructed of rollers which are arranged in abutting rolling contact so as to form a liquid-tight seal with one another. The rollers are constructed of relatively soft rubber such that film can be passed between adjacent rollers in the side walls directly into the solution.

5 Claims, 2 Drawing Sheets

ROLLER TANK

BACKGROUND OF THE INVENTION

The invention relates, generally, to a film developer apparatus and, more particularly, to a roller tank system therefor.

Film developer apparatuses, such as those used to develop x-ray film, typically consist of a plurality of driven rollers for conveying an exposed film through a liquid developer bath, a liquid fixer bath and a rinsing bath. The developer and fixer baths typically consist of alkaline and acidic solutions, respectively, and the rinsing bath typically consists of water. After passing through these baths the film is dried by a hot air drier and dispensed from the developer apparatus.

In the known systems, the developer, fixer and rinsing solutions are contained in plastic or stainless steel tanks. These tanks are open at the top such that the film can be brought into contact with the solutions.

As is well known in the film developer art, the film can be brought into contact with the solutions by one of two methods. In the so called, "deep tank" method, a complex arrangement of transportation rollers or a transportation web moves the film through a serpentine path. These transport rollers or transport webs are arranged such that the film is conveyed into the tanks and is immersed in the solutions. One problem with such a transportation system is that the film must be bent so as to be able to travel through the serpentine path created by the rollers. This bending can damage the film. Moreover, to create the serpentine path a large member of rollers must be used such that these systems are relatively difficult and expensive to manufacture and maintain. Lastly, the pressure needed to transport the film along the serpentine path, whether by roller or by web, tend to leave marks on the film.

The other method of transporting film through a developer apparatus is the, so called, "straight through" method. In this method the rollers are arranged such that the film is conveyed horizontally in a straight line over the tops of the baths. Because the film is moved in a straight line, it cannot be immersed in the solutions. Therefore, a tray, through which the film travels, is disposed above each of the tanks. Solution from each of the tanks is continuously splashed onto the tray so as to contact both sides of the film as it passes through. While this method avoids bending the film, it is unable to immerse the film in the baths. As a result, the solutions must be continuously splashed onto the trays from the tanks. Because space is required between the rollers to accommodate the splashing apparatus, developers using this method are unable to handle small film such as dental x-rays.

Thus, an improved film developer that can immerse the film in solution without bending it and can handle film of virtually any size is desired.

SUMMARY OF THE INVENTION

The present invention provides a film developer apparatus in which film of virtually any size can be fully immersed in the liquid baths without bending the film. The front, back and bottom walls of the tanks containing the liquid baths are constructed of rollers which are arranged in abutting rolling contact. The rollers are constructed of relatively soft rubber such that film can be passed between adjacent rollers in the side walls directly into the solution.

OBJECTS OF THE INVENTION

It is a general object of the inventions to provide an improved film developer apparatus.

It is another object of the invention to provide a tank for retaining liquid constructed of rollers in abutting rolling contact.

It is a further object of the invention to provide a delivery system for a film developer apparatus in which the film can be immersed in the liquid baths while being transported along a straight line.

Other objects of the invention, in addition to those set forth above, will become apparent to one of ordinary skill in the art from the following detailed description of the invention.

DETAILED DESCRIPTION OF THE INVENTION

Figure 1:
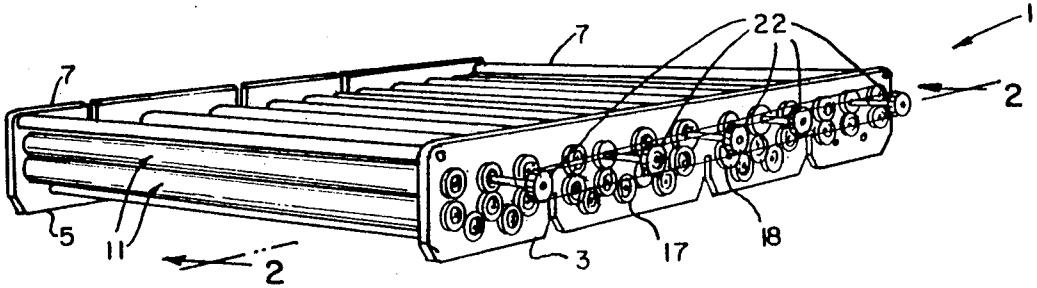
FIG. 1 shows a perspective view of the roller tank of the invention.

The roller tank of the invention is shown generally at 1 in the figures and consists of a first frame member 3 and a second frame member 5. Frame members 3 and 5 are connected together by spacer bars 7 which engage apertures found in frame members 3 and 5 and are secured thereto by suitable fasteners.

Trapped between the frame members 3 and 5 are a plurality of identical roller assemblies 11. Each roller assembly 11 consists of a shaft 13 having a low durometer rubber roller 15 mounted thereon. The shafts 13 are, preferably, mounted in roller bearing assemblies 17; however, bearings 17 can be eliminated where the friction between frame members 3 and 5 and shafts 13 is low. Roller bearing assemblies 17 are secured in frame members 3 and 5 such that the adjacent rollers abut one another under a pressure sufficient to create a liquid-tight seal between the rollers while at the same time allowing the rollers to roll relative to one another.

A thin lubricating washer 19, constructed of a material having a low coefficient of friction such as Teflon, is mounted on shaft 13 between the ends of rollers 15 and the frame members 3 and 5. The washers 19 are provided to eliminate the contact between the ends of rollers 15 and frame members 3 and 5 and minimize the sliding frictional force between these elements. Without washer 19 the frictional force resulting from such contact could be great enough to prevent the rollers from turning. It should be noted that because rollers 50 do not form a part of the bottom or sidewalls of the tank, as will hereinafter be described, a space 14 can be left between the ends of these rollers and the frame members such that washers 19 do not have to be used with rollers 50.

Mounted on one end of shafts 13 to the outside of frame member 3 are meshing gears 21. Mounted on the other end of selected ones of the shafts 13 are drive gears 22. A drive motor 23 is operatively connected to gears 22 such that actuation of motor 23 results in the turning of all of the rollers 15. A transmission member 18 connecting gears 22 could be used to transmit the drive of motor 23. In the illustrated embodiment, gears 21 are used to transmit the force of motor 23 to the rollers; however, it will be appreciated by one skilled in the art that the gears could be eliminated and the force could be transmitted between the rollers by the direct roller to roller contact.

Figure 2:
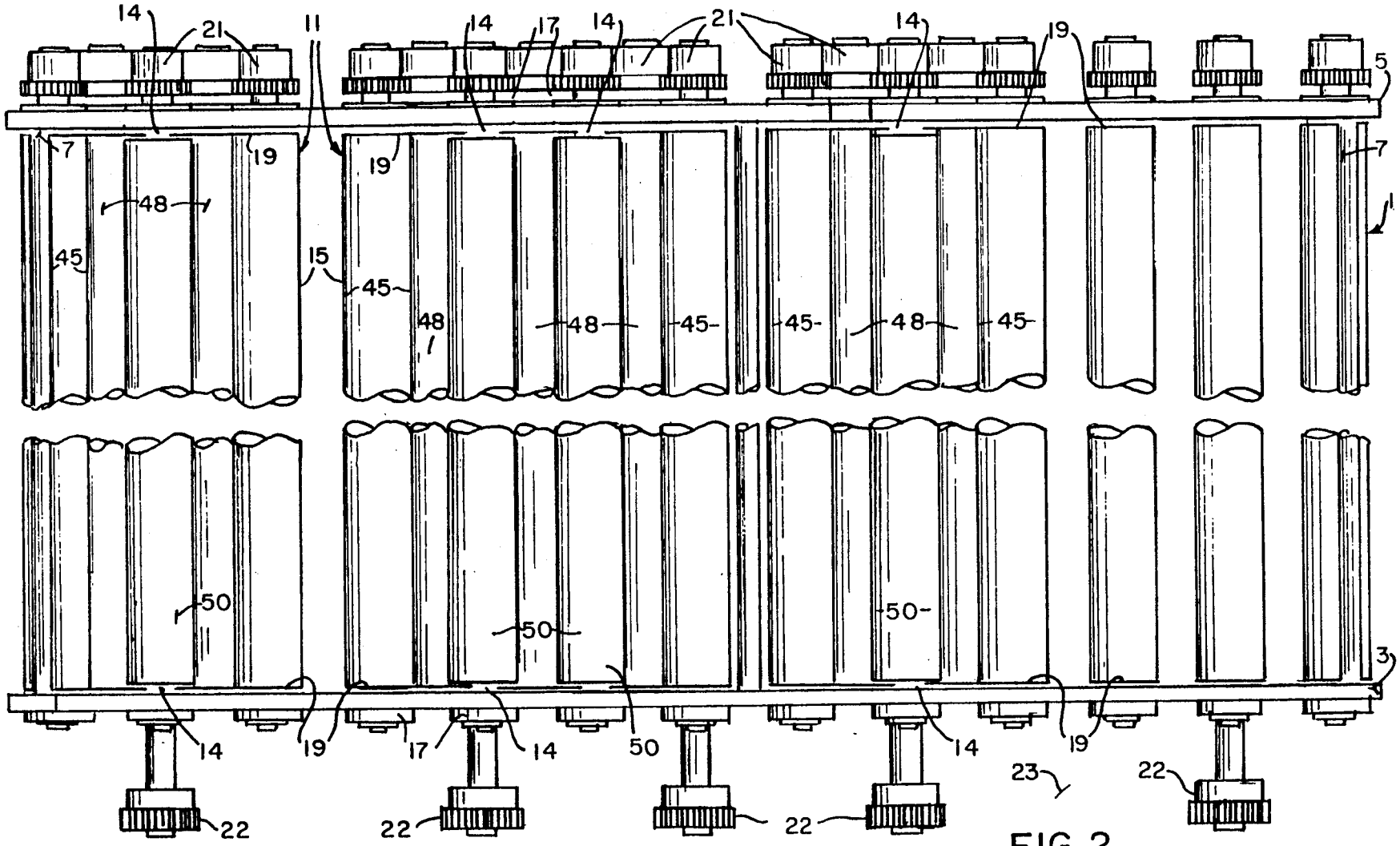
FIG. 2 shows a top view of the roller tank of the invention.

As best shown in FIG. 2, the rollers are arranged to form a first tank 25 for retaining developer solution 27, a second tank 29 for retaining fixer solution 31 and a third tank 33 for retaining rinsing solution 35. The tanks are of similar construction and consist of upper sidewall rollers 45, lower sidewall rollers 46 and bottom rollers 48. Rollers 48 can be constructed of a hard material because they do not contact film 47. Intermediate rollers 50 are provided to facilitate the conveyance of film 47 through the system. Each of tanks 25, 29 and 33 are disposed over supply containers 37, 39 and 41, respectively, which contain the developer, fixer and rinsing solutions as will be appreciated by one skilled in the art. It is further contemplated that frame members 3 and 5 be made of plurality of segments such that tanks 25, 29 and 33 are independent racks which could be removed separately from the developer apparatus.

Figure 4:
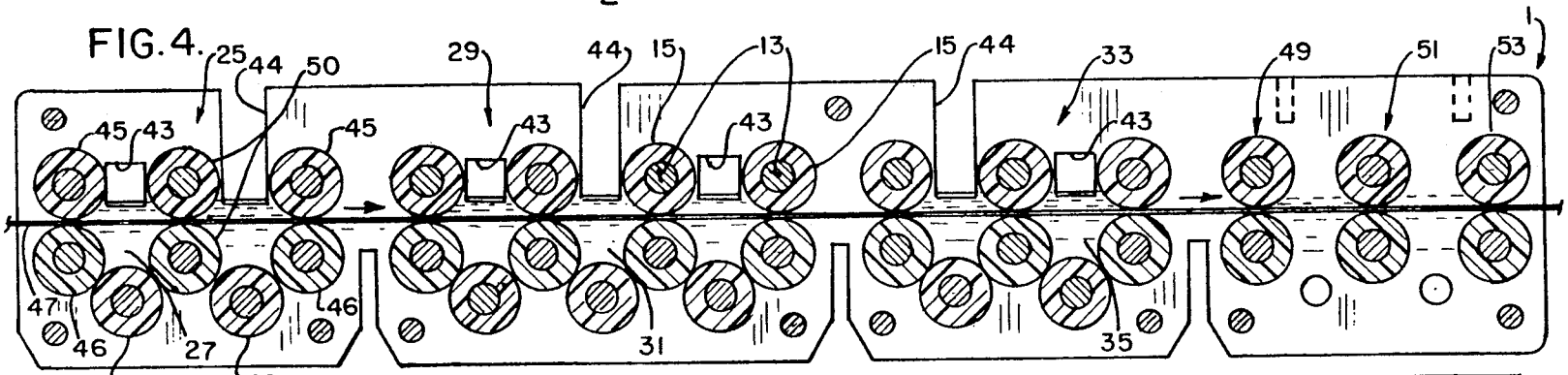
FIG. 4 shows a section view of the roller tank taken along line 2—2 of FIG. 3 in association with a developer apparatus.

The developer, fixer and rinsing solutions are continuously pumped from containers 37, 39 and 41 into tanks 25, 29 and 33 respectively. Apertures 43 are provided in frame members 3 and 5 to control the level of solution in the tanks by spilling off the overflow solution back into containers 37, 39 and 41. The apertures 43 ar arranged in frame members 3 and 5 such that the solution level is maintained above the bottom of the upper sidewall roller 45 as best shown in FIG. 4. Cut-outs 44 are provided to allow new solution to be pumped into the tanks from containers 37, 39 and 41 as well as to allow for spillage. The spillage of the solutions through apertures 43 and cut-outs 44 also serves to continuously recirculate the solution in the tanks such that the supply of solution is fresh In operation, the developer apparatus is turned on such that all of rollers 15 are rotated by motor 23 and the fluid level in tanks 25, 29 and 33 is maintained. The film 47 is inserted between the upper and lower sidewall rollers of tank 25. The engagement of the rotating rollers with film 47 causes the film to be conveyed through the solution in straight line until it engages the next pair of sidewall rollers. In the same manner, the film is conveyed from tank 25, to tank 29 and then to tank 33. As the film passes through each tank it is completely immersed in the solution as best illustrated in FIG. 2. Upon exiting tank 33 the film passes through the pairs of rollers 49, 51 and 53 where drier 55 blows hot air over film 43 to dry it before it is dispensed from the developer apparatus.

Figure 3:
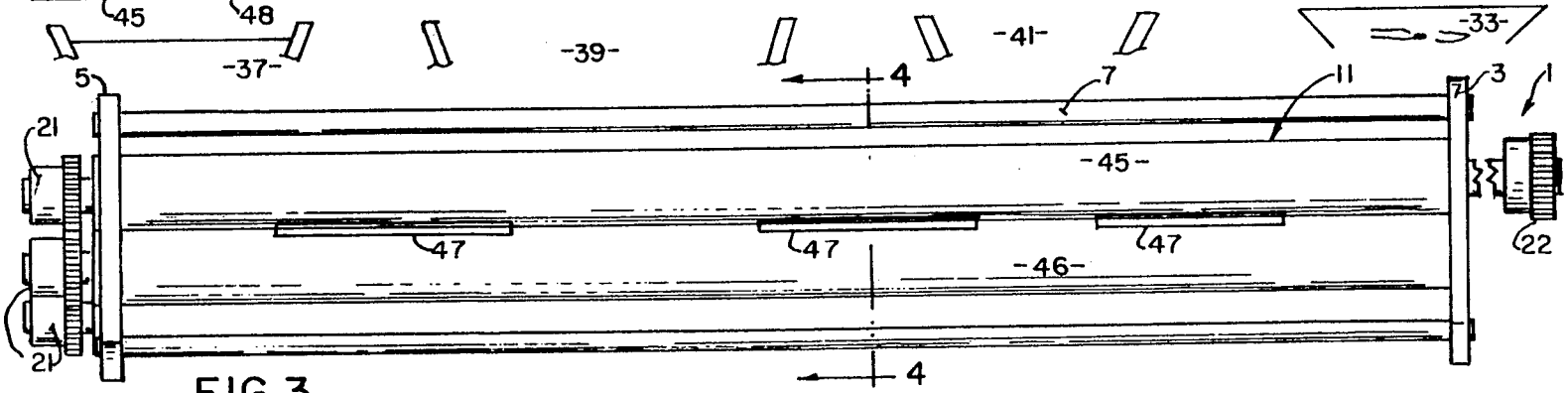
FIG. 3 shows an end view of the roller tank of the invention.

Referring more particularly to FIG. 3, because rollers are constructed of a soft resilient rubber, they will deform as film 47 passes between the rollers to closely conform to the profile of film 47. In so doing, substantially no gaps are created between the rollers such that a minimum amount of solution escapes from the tanks.

Because the film can pass through the side walls of the tanks, the film can be completely immersed in solution while traveling in a straight line. Thus bending of the film as required in the prior art devices is eliminated. Moreover, the delivery system can transport films of virtually any size including small dental x-rays.

While the invention has been shown and described in some detail, it will be understood that this description and the accompanying drawings are offered merely by way of example and that the invention is to be limited in scope only by the appended claims.

What is claimed:

1. An apparatus for conveying a work piece through a fluid bath, comprising:

a plurality of tank sections, each of said tank sections including a pair of spaced upper opposed side wall rollers, a pair of spaced lower opposed side wall rollers, respective individual ones of the pair of said upper and lower opposed side wall rollers abutting one another, a plurality of bottom rollers, at least two of said bottom rollers respectively abutting at least two of said side wall rollers, respectively and a pair of intermediate rollers, at least one of said intermediate roller pair abutting both of said at least two bottom rollers and the other intermediate roller;

means for supporting said rollers for rotational movement, said supporting means including a pair of opposed frame members, and a plurality of shafts, each of said shafts having a respective roller mounted thereon, a friction reducing element mounted on preselected ones of said shafts along each end thereof, and means for mounting the rollers of at least said lower opposed side wall rollers and said bottom rollers against said frame in fluid leak resistant relationship; and a plurality of containers positioned beneath each of said tank sections, at least one of said frame members having prepositioned openings formed in it to permit direct fluid communication between respective one of said tank sections and the container associated with said respective tank section.

2. The apparatus of claim 1 further including means for rotating said rollers whereby the work piece can be fed between adjacent ones of said rollers to be immersed in said fluid bath.

3. The apparatus of claim 2 wherein the fluid depth in each of said tanks sections is above the pair of opposed lower sided wall rollers.

4. The apparatus of claim 3 wherein said work piece is fed between said upper and lower side wall rollers.

5. The apparatus of claim 4 wherein said tank sections defined by said roller plurality are independently removable from said apparatus.

* * * * *